United States Patent [19]

Ohsato

[11] 4,368,861

[45] Jan. 18, 1983

[54] FRAME CONNECTING MEMBER OF A KITE

[76] Inventor: Hiroshi Ohsato, 23-3, 2-chome, Higashi-Mukojima, Sumida-ku, Tokyo, Japan

[21] Appl. No.: 218,015

[22] Filed: Dec. 18, 1980

[30] Foreign Application Priority Data

Nov. 7, 1980 [JP] Japan ..... 55-159244[U]

[51] Int. Cl.[3] ..... B64C 31/06; F16D 1/00

[52] U.S. Cl. ..... 244/153 R; D8/382; D21/88; 403/173; 403/346

[58] Field of Search ..... 244/153 R, 154; 403/173, 175, 346, 347; 16/DIG. 13; D8/382; D21/88, 91

[56] References Cited

U.S. PATENT DOCUMENTS

| | | | |
|---|---|---|---|
| 3,116,902 | 1/1964 | Gould | 244/153 R |
| 3,161,386 | 12/1964 | Umanoff | 244/153 R |
| 3,305,198 | 2/1967 | Sellers | 244/153 R |
| 4,018,408 | 4/1977 | Pearce et al. | 244/153 R |
| 4,133,500 | 1/1979 | Chapman | 244/153 R |
| 4,286,762 | 9/1981 | Prouty | 244/153 R |

*Primary Examiner*—Charles E. Frankfort
*Attorney, Agent, or Firm*—Wenderoth, Lind & Ponack

[57] ABSTRACT

A frame connecting member of a kite formed as a unitary body and of an elastic material comprises a main body whose front and rear ends are formed as projections provided with kite string mounting holes and whose center is formed as a base with a through hole in the longitudinal direction for a longitudinal frame member; and supports provided respectively at the right and left outer sides of the base on the same straight line in the direction which perpendicularly intersects the axis of the main body. The supports can be tilted to a certain angle with respect to the straight line and are provided with holes into which are inserted lateral frame members which perpendicularly intersect the through holes. The corners on the main body side of the supports come in contact with the main body so as to prevent any further tilting. The kite string mounting holes are directed in the same direction as that of the through hole of the base.

4 Claims, 4 Drawing Figures

FRAME CONNECTING MEMBER OF A KITE

BACKGROUND OF THE INVENTION

The present invention relates to a frame connecting member which serves to connect a longitudinal frame of a kite with its lateral frame.

An object of the present invention is to provide a frame connecting member of a kite which is placed at the center thereof to connect a longitudinal frame of the kite with a lateral frame.

Another object of the present invention is to provide a frame connecting member of a kite which makes it possible for the lateral frames to tilt in the wind direction in accordance with the force of the wind so that the kite's ascending power is increased while utilizing the wind's acting force efficiently.

Still another object of the present invention is to provide a frame connecting member of a kite which also serves as a mounting part of kite strings, enabling the kite to be flown, connected with other kites.

DETAILED DESCRIPTION OF THE INVENTION

Figure 1:
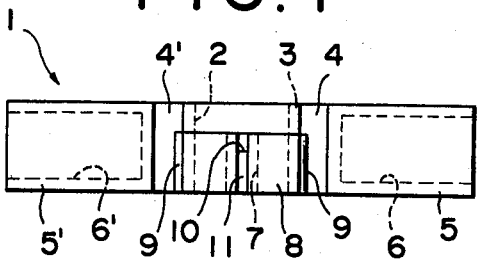
FIG. 1 is an elevational view of the frame connecting member in accordance with the present invention.

Now, the present invention will be explained in detail, based on an embodiment shown in the attached drawings.

A connecting member 1 in accordance with the present invention is formed as a single body made of elastic resin. Connecting pieces 4, 4' are respectively located approximately at the center of two opposite outer sides of a base 3 provided with a through longitudinal hole 2. Supports 5, 5' which have almost the same height and width as those of the base 3 extend sideways from the base through the connecting pieces 4, 4'. Holes 6, 6' which perpendicularly intersect the through hole 2 of the base 3 and which are closed on the base side, are provided in the supports.

On the other pair of opposite outer sides (front and rear sides) of the base 3 are provided projections 8, 8' to form a main body together with the base. The ends of projections 8, 8' are arcuate. String mounting holes 7, 7' are respectively formed in projections 8, 8' in the same direction as that of the through hole 2. The bottom surfaces of the projections 8, 8' correspond to that of the base 3, while its top surface is lower than the base. At the connections of the projections 8, 8' with the base 3 protrusions 9 which extend along the height of the projections 8, 8', are provided. At the mounting hole 7 of projection 8 a horizontal concave groove 10 which extends towards the edge of the projection, is provided, and it is continued to a vertical concave groove 11 provided at the edge.

Figure 2:
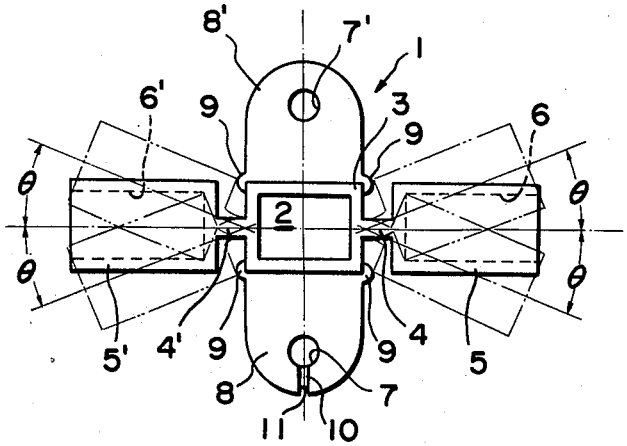
FIG. 2 is a plan view of the frame connecting member.
Figure 3:
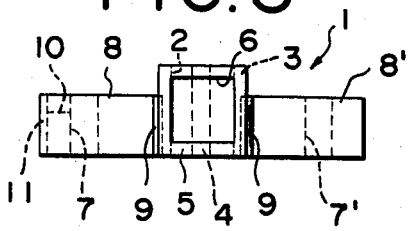
FIG. 3 is a side view of the frame connecting member.
Figure 4:
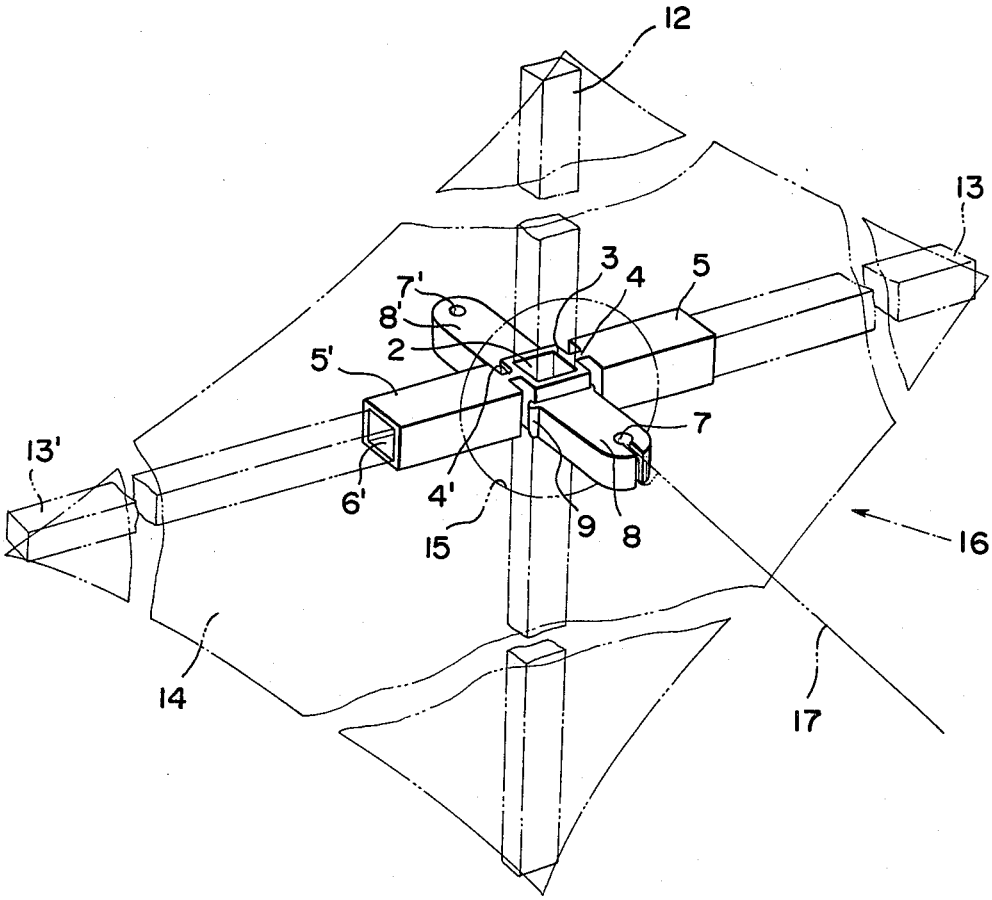
FIG. 4 is a schematic perspective showing a kite as assembled, using the frame connecting member in accordance with the present invention.

As shown in FIG. 2, the supports 5, 5' can be tilted through the connecting members 4, 4' by an angle $\theta$ obtained when rear end corners of the supports come in contact with the protrusions 9, which angle is respectively 10°-20° from the original positions of the supports where the supports vertically intersect the projections 8, 8'. Since as seen in FIG. 2 and FIG. 4 connecting members 4, 4' have much wider dimensions in the vertical (longitudinal) direction than in the horizontal, connecting members 4, 4' are relatively rigid against vertical tilt.

When a kite is to be assembled, using the connecting member 1 which is composed as described above, a longitudinal frame member 12 is inserted in the base 3 in the manner that its center is located in the through hole 2, and the rear ends of lateral frame members 13, 13' are respectively inserted in the holes 6, 6' of the supports 5, 5'. The longitudinal frame member 12 and the lateral frame members 13, 13' thus form a cross, and a lozenge-shaped polyethylene sheet 14 is applied to the longitudinal frame member 12 and the lateral frame members 13, 13' in such a manner that the projection 8 with the horizontal and vertical concave grooves protrudes from the hole 15 provided in the center of the sheet 14.

If the longitudinal frame member 12 and the lateral frame members 13, 13' are made of resin, application of the polyethylene sheet can be easily done by heat welding or by an adhesive or the like.

When preparing to fly the kite assembled as described above, a kite string 17 is passed around and tied in the hole 7 of the projection 8 protruding from the polyethylene sheet 14. As the string is passed over the horizontal and vertical grooves 10, 11, it is securely maintained in the proper position. Then a strap-like object (not shown) which serves as the center of gravity, is mounted for example by an adhesive tape in the vicinity of the lower end of the longitudinal frame member 12, and preparation of the kite is completed.

As the connecting member 1 is of flexible elastic material, and the supports 5, 5' can be tilted with respect to the base 3, in actually flying the kite the longitudinal frame member 12 and the lateral frame members 13, 13' remain in the same plane when the wind's acting force is small so that the polyethylene sheet is widely spread in the wind's direction, giving the kite strong rising power; while, when the wind's force is too great, the supports 5, 5' which carry the lateral frame members 13, 13', are tilted leeward, and as a result of this the part of the polyethylene sheet 14 located at the longitudinal frame member 12 serves as an edge, getting rid of unnecessary wind force.

Further, in case an adverse wind occurs after the kite has gone up to a certain height, the supports 5, 5' are tilted in the direction opposite to the above-mentioned one, giving away the force of the adverse wind, and when a fair wind returns, the supports 5, 5' go back to the above-mentioned position.

When a plural number of the above-described kites are to be flown as a series of connected kites, the kites may be coupled by connecting the two mounting holes 7 and 7' of successive kite frame connecting members with lengths of strings.

In the present embodiment the protrusions 9 are provided at the connections of the base 3 and the projections 8, 8' in order to control the maximum tilting angle of the supports 5, 5' as they come in contact with the protrusions, but it is needless to say that the protrusions may be omitted and that the maximum tilting angle is controlled by arranging the length of the connecting pieces 4, 4' so that the rear end corners of the supports 5, 5′ come directly in contact with the above connecting parts. Also, the maximum tilting angle need not be limited in the range of 10°–20°.

By composing the present invention as above, unitary molding is possible, enabling the kite frame connecting members to be econimically mass produced. Assembling efficiency with the kite frame connecting member 1 is increased, as it is quite easy to connect the longitudinal frame member and the lateral frame members. Further, application of the polyethylene sheet is also simple, as the longitudinal and lateral frame members form a cross in the same plane. Kites assembled with the present connecting member can deal efficiently with different wind forces, and it is further possible to fly them as a series of connected kites. The present invention thus presents many advantages.

What is claimed is:

1. A frame connecting member for a kite comprising a unitary body formed of elastic material including:

a main body having oppositely extending projections and a central base portion between said projections, having a through hole extending in a longitudinal direction for receiving a longitudinally extending frame member along a longitudinal axis, said projections each having kite string mounting holes formed therein;

first and second lateral support members respectively extending along a lateral line extending perpendicularly to said longitudinal direction, said first and second lateral support members each having opposite first and second sides, said first and second lateral support members also having laterally extending holes opening at their respective first sides for receiving laterally extending frame members along a lateral axis; and first and second elastic connection pieces respectively connecting said second sides of said first and second lateral support members to opposite sides of said central base portion of said main body such that said first and second lateral support members are elastically tiltable about said longitudinal axis through a predetermined angle $\theta$ to opposite sides of said lateral axis;

said main body comprising means for contacting said first and second lateral support members when said first and second lateral support members are tilted, to limit the degree of said tilting to said predetermined angle $\theta$ to opposite sides of said lateral axis.

2. A frame connecting member as in claim 1 wherein said central base portion has corners, said corners constituting said contacting means.

3. A frame connecting member as in claim 1 wherein said kite string mounting holes extend in said longitudinal direction.

4. A frame connecting member as in claim 1 wherein said first and second connection pieces have longitudinal dimensions much greater than their lateral dimensions so as to be relatively rigid against tilting of said first and second lateral support members, respectively, in said longitudinal direction.

* * * * *